US006527483B1

(12) United States Patent
Agee

(10) Patent No.: US 6,527,483 B1
(45) Date of Patent: Mar. 4, 2003

(54) RETAINING WALL ASSEMBLY

(76) Inventor: Frederic R. Agee, P.O. Box 351, Westover, AL (US) 33185

( * ) Notice: Subject to any disclaimer, the term of this patent is extended or adjusted under 35 U.S.C. 154(b) by 0 days.

(21) Appl. No.: 09/879,375

(22) Filed: Jun. 11, 2001

Related U.S. Application Data

(63) Continuation-in-part of application No. 09/407,253, filed on Sep. 28, 1999, now abandoned.

(51) Int. Cl.[7] ..... E02D 17/20
(52) U.S. Cl. ..... 405/284; 405/286
(58) Field of Search ..... 405/284–287, 405/262

(56) References Cited

U.S. PATENT DOCUMENTS

| | | | | |
|---|---|---|---|---|
| 2,313,363 A | | 3/1943 | Schmitt | 405/286 |
| 4,490,075 A | | 12/1984 | Risi et al. | 405/273 |
| D280,024 S | | 8/1985 | Risi et al. | D25/113 |
| D296,007 S | | 5/1988 | Forsberg | D25/116 |
| 4,802,320 A | | 2/1989 | Forsberg | 52/585.1 |
| 4,825,619 A | | 5/1989 | Forsberg | 405/286 |
| 5,044,834 A | | 9/1991 | Janopaul, Jr. | 405/284 |
| 5,214,898 A | | 6/1993 | Beretta | 52/606 |
| 5,252,017 A | | 10/1993 | Hodel | 411/446 |
| 5,257,880 A | | 11/1993 | Janopaul, Jr. | 405/284 |
| 5,505,034 A | | 4/1996 | Dueck | 52/604 |
| 5,507,599 A | * | 4/1996 | Anderson et al. | 405/262 |
| 5,535,568 A | | 7/1996 | Quinn | 52/608 |
| 5,704,183 A | | 1/1998 | Woolford | 52/604 |
| 5,788,423 A | | 8/1998 | Perkins | 405/284 |
| 5,795,105 A | | 8/1998 | Guth | 405/284 |
| 5,827,015 A | | 10/1998 | Woolford et al. | 405/286 |
| 5,913,790 A | | 6/1999 | Dawson | 52/609 |
| 5,941,042 A | | 8/1999 | Dueck | 52/604 |
| 5,951,210 A | | 9/1999 | Maguire et al. | 405/286 |
| 6,062,772 A | | 5/2000 | Perkins | 405/284 |
| 6,113,318 A | | 9/2000 | Guth | 405/284 |

FOREIGN PATENT DOCUMENTS

JP 09032095 A * 2/1997

* cited by examiner

*Primary Examiner*—Robert E. Pezzuto
*Assistant Examiner*—Tara L. Mayo
(74) *Attorney, Agent, or Firm*—Smith, Gambrell & Russell, LLP

(57) ABSTRACT

A retaining wall assembly includes a plurality of block elements having a major face wall and minor face wall and a pair of opposing converging walls connecting the major face wall and the minor face wall. The block elements are arranged in multiple rows with a mesh grid separating predefined rows of block elements. The block elements define an open core into which a plurality of anchoring stones are distributed. A synthetic resin is also dispersed in the open cores of the block elements to provide a positive connection between the anchoring stones and the mesh grid, thereby reinforcing the position of the retaining wall.

20 Claims, 4 Drawing Sheets

RETAINING WALL ASSEMBLY

The present patent application is a continuation-in-part of U.S. patent application Ser. No. 09/407,253 filed Sep. 28, 1999, now abandoned.

FIELD OF THE INVENTION

The present invention relates to retaining walls. More particularly, the present invention relates to internally filled retaining walls prepared from a plurality of open core, man-made block elements having a trapezoidal structure, wherein the major face of the block elements form the outer surface of the retaining wall. Even more specifically, the present invention relates to a retaining wall comprised of a series of open core retaining wall block elements that are securely arranged using an anchoring composition including a plurality of anchoring stones and a synthetic resin.

BACKGROUND OF THE INVENTION

Soil retention, protection of natural and artificial structures, and increased land use are only a few reasons which motivate the use of landscape structures. For example, soil is often preserved on a hillside by maintaining the foliage across that plane. Root systems from trees, shrubs, grass, and other naturally occurring plant life work to hold the soil in place against the forces of wind and water. However, when reliance on natural mechanisms is not possible or practical man often resorts to the use of artificial mechanisms such as retaining walls.

In constructing retaining walls many different materials may be used depending upon the given application. If a retaining wall is intended to be used to support the construction of an interstate roadway, a steel retaining wall, perhaps combined with concrete, may be appropriate. However, if the retaining wall is intended to landscape and conserve soil around a residential or commercial structure, a material may be used which compliments the architectural style of the structure such as wood timbers or concrete block.

Of all these materials, concrete block has received wide and popular acceptance for use in the construction of retaining walls and the like. Blocks used for these purposes include those disclosed by Risi et al, U.S. Pat. Nos. 4,490,075 and Des. 280,024 and Forsberg, U.S. Pat. Nos. 4,802,320 and Des. 296,007 among others. Blocks have also been patterned and weighted so that they may be used to construct a wall which will stabilize the landscape by the shear weight of the blocks. These systems are often designed to "setback" at an angle to counter the pressure of the soil behind the wall. Setback is generally considered the distance which one course of a wall extends beyond the front of the next highest course of the same wall. Given blocks of the same proportion, setback may also be regarded as the distance which the back surface of a higher course of blocks extends backwards in relation to the back surface of the lower wall courses. In vertical structures such as retaining walls, stability is dependent upon the setback between courses and the weight of the blocks.

For example, U.S. Pat. No. 2,313,363 to Schmitt discloses a retaining wall block having a tongue or lip which secures the block in place and provides a certain amount of setback from one course to the next. The thickness of the Schmitt tongue or lip at the plane of the lower surface of the block determines the setback of the blocks. However, smaller blocks have to be made with smaller tongues or flanges in order to avoid compromising the structural integrity of the wall with excessive setback. Manufacturing smaller blocks having smaller tongues using conventional techniques results in a block tongue or lip having inadequate structural integrity. Concurrently, reducing the size of the tongue or flange with prior processes may weaken and compromise this element of the block, the course, or even the entire wall.

The current design of pinless, mortarless masonry blocks generally also fails to resolve other problems such as the ability to construct walls which follow the natural contour of the landscape in a radial or serpentine pattern. Previous blocks also have failed to provide a system allowing the use of anchoring mechanisms which may be affixed to the blocks without complex pinning or strapping fixtures. Besides being complex, these pin systems often rely on only one strand or section of a support tether which, if broken, may completely compromise the structural integrity of the wall. Reliance on such complex fixtures often discourages the use of retaining wall systems by the every day homeowner. Commercial landscapers generally avoid complex retaining wall systems as the time and expense involved in constructing these systems is not supportable given the price at which landscaping services are sold. As can be seen the present state of the art of forming masonry blocks as well as the design and use of these blocks to build structure has definite shortcomings.

The applicant herein has solved some of the problems with a concrete block approach wherein the block was constructed in a trapezoidal form with parallel front and rear walls and a pair of sidewalls converging from front to rear. Unfortunately, while the blocks were quite useful in allowing a wall made therefrom to follow a serpentine pattern, the strength of the blocks was insufficient to avoid breakage during installation of numerous blocks, thus making the use of the blocks uneconomical.

SUMMARY OF THE INVENTION

The present invention is intended for use in decorative and functional walls which can be constructed as a gravity wall system, geogrid system, pyramid system, or as a combination of all of the these. In general, the retaining element disclosed in the assembly discussed herein is an improvement over the shaped block previously used by the applicant and provides greater strength per unit for the fabrication of the wall. As with the prior art system used by the Applicant, each element has a large core. In the present invention, the block elements provide maximum stability through the inclusion anchoring stone and a synthetic resin that surround a mesh grid or mat that is placed between the block elements. More specifically, two rows of block elements are separated by the mesh grid, with anchoring stones traversing the cores of the block elements. The liquid resin is thereby used to connect the mesh grid and the anchoring stones to provide a positive connection and strength not found in competitive products without more complicated designs. The construction of the block elements increases the wall strength of the converging walls such that they are less susceptible to fracture during construction of the wall, by adding mass to the walls without significantly diminishing the core area, and the anchoring stones and resin further strengthen the completed retaining wall.

These and other objects and advantages of the invention will become apparent from the following detailed description of the preferred embodiment of the invention.

BRIEF DESCRIPTION OF THE DRAWINGS

The improved retaining wall assembly formed is depicted in the appended drawings which form a portion of this disclosure and wherein.

DESCRIPTION OF THE PREFERRED EMBODIMENT

Figure 1:
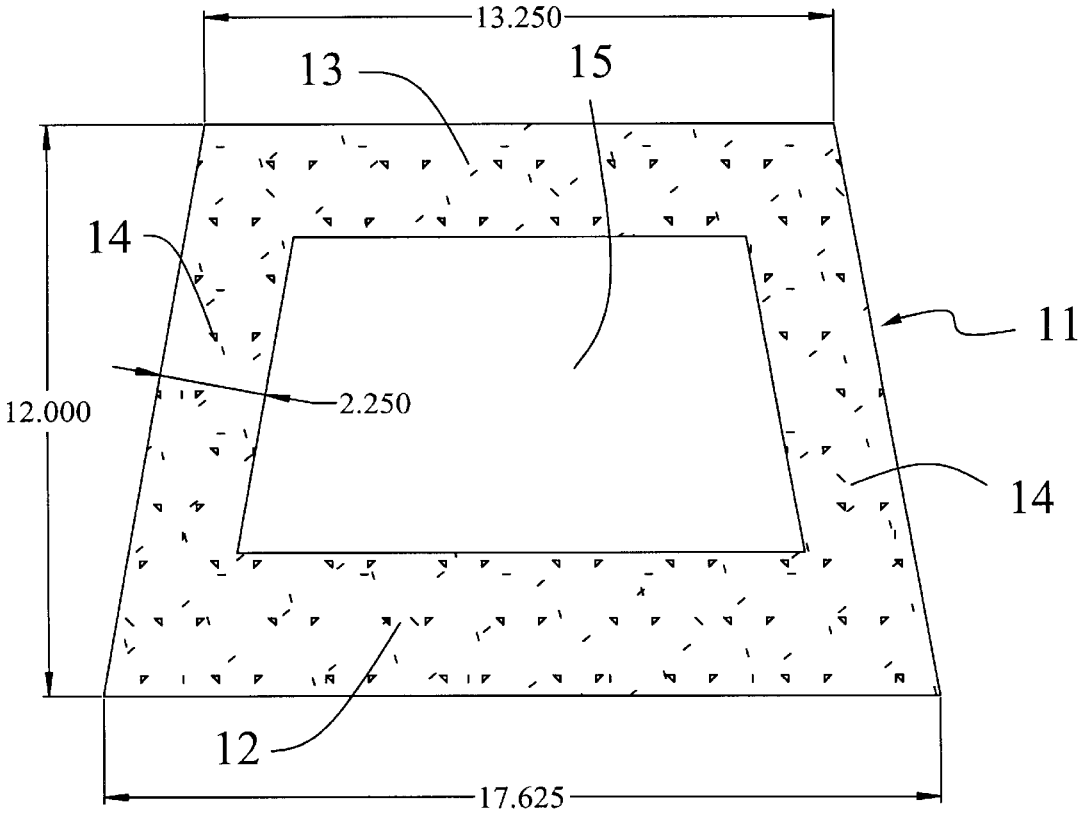
FIG. 1 Prior Art
FIG. 1 is a top plan view of the prior art block element.

Referring to FIG. 1, block elements 11 used in the Applicant's initial prototype system are illustrated. The block elements 11 were generally trapezoidal in shape, having a face 12 measuring seventeen and five-eighths inches across, a parallel face 13 measuring thirteen and one-fourth inches and having a depth from front face to rear face of twelve inches. The height of each block element 11 was eight inches. Moreover, each block element 11 defined a central core 15 traversing the block element 11, with the central core 15 having an internal volume of approximately one-half cubic foot. The thickness of the major face 12 was three inches, and the thickness of the minor face 13 was two and three-eighths inches. The thickness of each of the converging walls 14 was two and one-fourth inches.

These prototype elements were used in retaining walls in both residential and commercial landscaping environments. Through this research and use, it was determined that the strength of the converging walls 14 was insufficient to allow the block elements 11 to be used as anticipated. Specifically, the block elements 11 are laid one over the other in a laterally overlapping pattern such that the converging walls 14 are not supported along their entire length by the converging walls 14 of the subjacent block element 11, but rather, cross the subjacent converging walls 14 at an included angle of about 60 degrees. It is routinely necessary to use a mallet to tap or pound one the top of the block elements 11 to properly seat the individual block elements 11 in close fitting courses. Unfortunately the crossing of the converging walls 14 of abutting block elements 11 creates stress points which are accentuated by the use of the mallet such that the converging wall 14 or subjacent converging wall 14 frequently fractures in the prototype. On several occasions, these block elements 11 had been tested under through applying compressive forces to the block elements 11. Such testing studies indicated that these block designs provided only marginal results, and that it improvements in the block elements 11, particularly the wall size of the block elements 11, were necessary.

Referring now to FIGS. 2 through 5, the trapezoidal block elements 20 for forming an improved retaining wall 30 of the present invention are illustrated. The retaining wall 30 is designed to provide retention of a desired backfill material 8, such as dirt or rocks. As with the block elements 11 of the prior design, the block elements 20 of the present invention have a major face 22, a minor face 24, and a pair of converging walls 26 that join the two faces 22, 24. Additionally, an open central core 28 or aperture traverses the block elements 20 as in prior designs. However, the improved block elements 20 are designed to alleviate the problem of weakness that occurred in the prototype block elements 11 while maintaining the high stability offered by the open core design. More specifically, the improved block elements 20 provide a means to strengthen retaining wall 30, with the block elements 20 having converging walls 26 that do not significantly diminish the volume of the open central core 28 of the block elements 20, and that are further reinforced by the distribution of an anchoring composition 31 in the central core 28.

Figure 2:
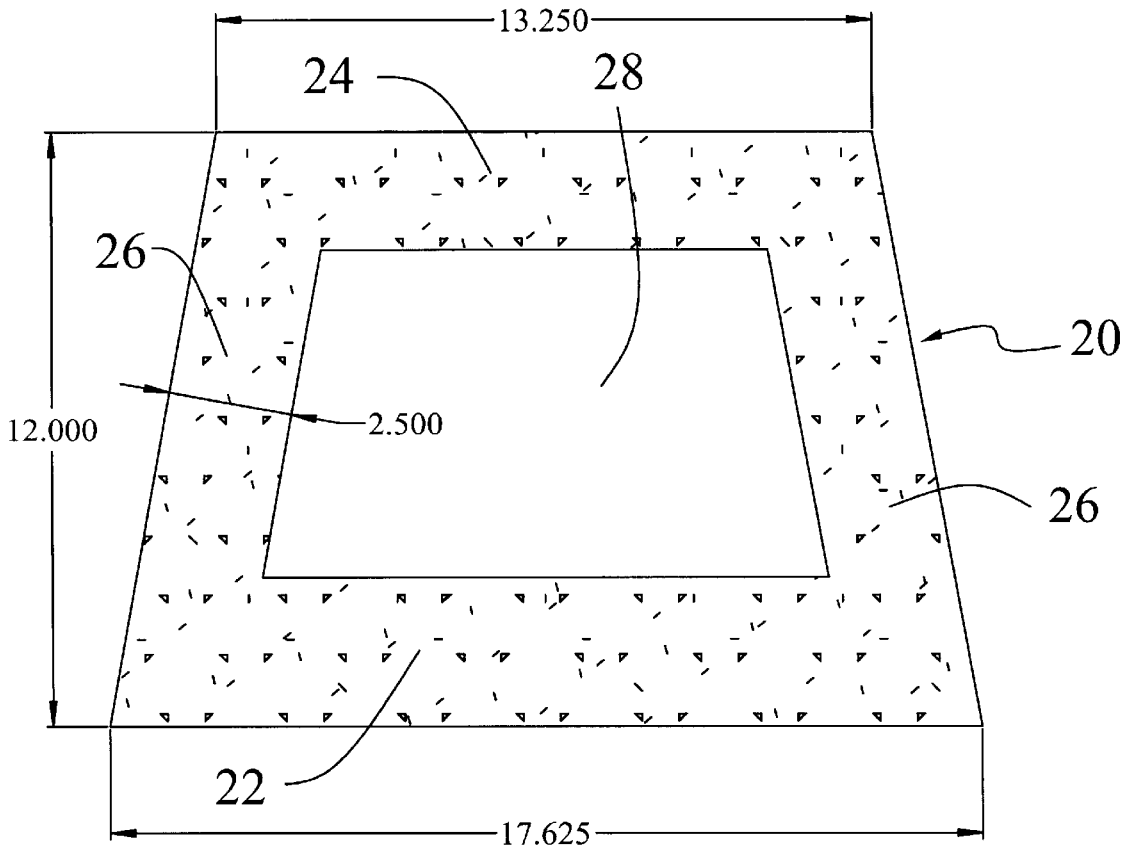
FIG. 2 is a top plan view of an block element used in the improved retaining wall assembly of the present invention.
Figure 3:
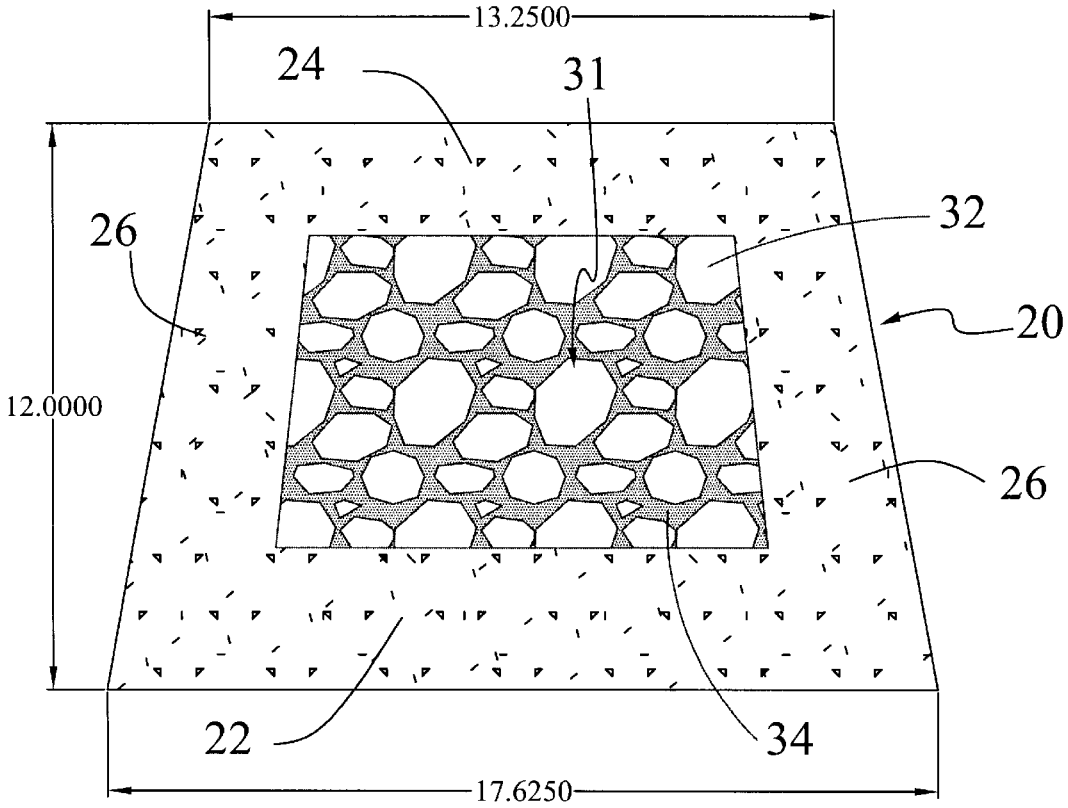
FIG. 3 is a sectional top view of the block element used in the improved retaining wall assembly of the present invention, with the view illustrating an anchoring composition filing the central core of the block element.
Figure 5:
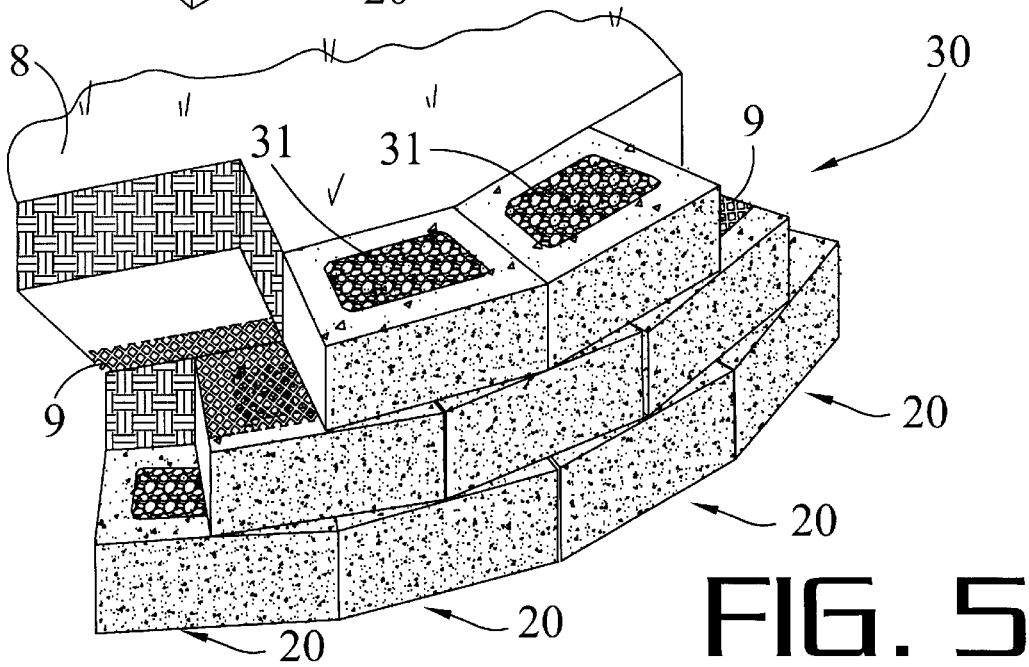
FIG. 5 is a perspective view of a curved retaining wall constructed with block elements of the present invention.

Continuing to view FIGS. 2 and 5, the block elements 20 have an isosceles trapezoidal shape and may be laid to form a corner at perpendicular walls using two adjacent block elements 20 abutting along adjacent converging faces 26. A third block element 20 with a converging face 26 adjacent the second block element 20 further yields a semi-circular turn in the retaining wall 30 (see FIG. 5). Thus it may be seen that the shape of block elements 20 lends itself to excellent continuous flexibility of design of the retaining wall 30. As a result, it is desirous to preserve the trapezoidal shape of the block elements 20 to maintain the strength of the retaining wall 30.

In view of this determination, two alternatives were devised to provide strength of the retaining wall 30 but maintaining the trapezoidal shape. In the first alternative, each converging wall 26 is uniformly increased in thickness in the interior of the block element 20 by up to 0.30 inches. In so doing the volume of central core 28 is maintained at least 0.45 cubic feet. In the second alternative, converging walls 26 are gradually increased in thickness such that they flare inwardly from the minor wall 24 to the major wall 22 such that the widest portion of the converging wall 26 has an increased thickness of up to three inches. Once again, the interior volume of open core 28 is maintained at greater than 0.45 cubic feet, while the volume of the central core 28 remains equivalent to the open core 15 of block element 11.

It should also be noted that any variation of the exterior size of the individual block elements 20 would affect handling and versatility of the block element 20 by the user (such as a mason). That is to say, masons are accustomed to handling conventional concrete blocks which are 18"×8"×12", thus the present block elements 20 are designed to maintain the block elements 20 close to the same dimensions. Additionally, with the existing dimensions, the block elements 20 can be readily adjusted in relation to each adjacent block element 20 to form a serpentine or faceted retaining wall 30 (see FIG. 5) which can follow a contour along eighteen-inch segments.

Figure 4:
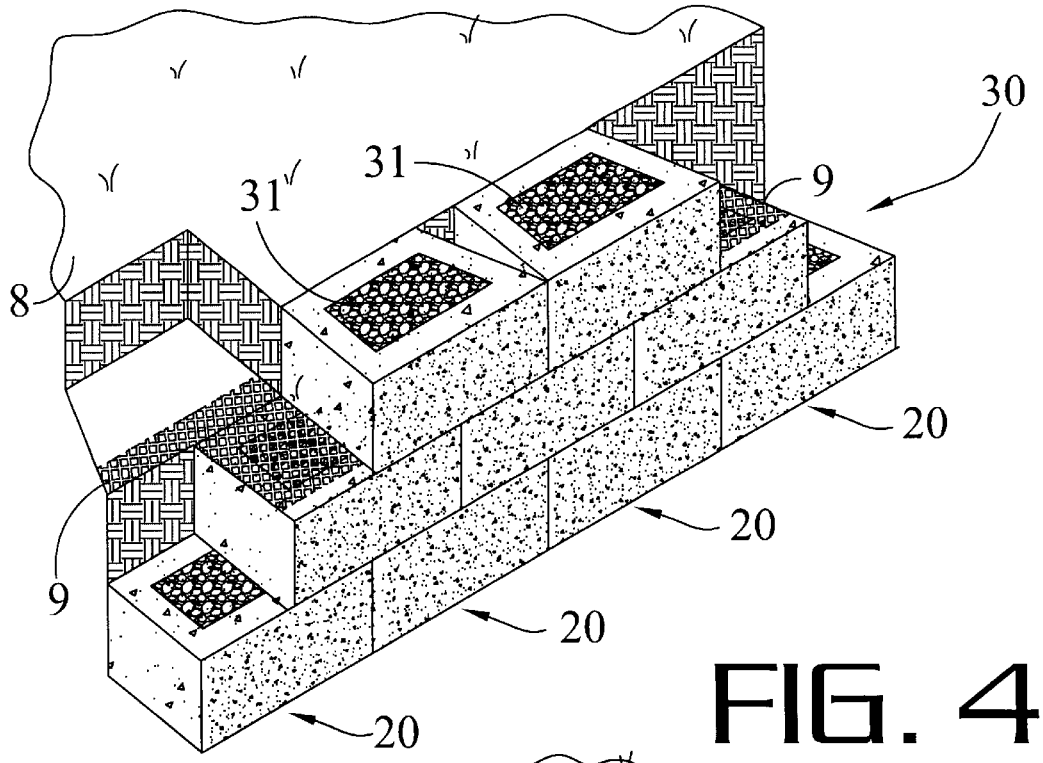
FIG. 4 is a perspective view of a straight retaining wall constructed with block elements of the present invention.

Looking at FIGS. 4 and 5, the retaining wall 30 made of block elements 20 is strengthened using an anchoring composition 31, preferably comprised of a plurality of anchoring stones 32. Generally, the anchoring composition 31 is distributed into the open core 28 to provide a "positive connection" between adjacent block elements 20. The positive connection created by the anchoring stones 32 will resolutely tie each block element 20 to the block elements 20 positioned above and below to form the steadfast retaining wall 30. Consequently, this anchoring composition 31 joins the vertically abutting block elements 20 to provide the resolute and securely positioned retaining wall 30.

Continuing to look at FIGS. 4 and 5, the preferred embodiment of the process for preparing the retaining wall 30 begins with the user arranging various block elements 20 in the number of multi-tiered rows as desired. The rows of the block elements 20 abut a backfill or other reinforced zone 8. Additionally, a mesh mat or grid 9 is preferably placed between rows of the block elements 20 to further secure the assembly to the ground surface 8. Each row of block elements 20 should preferably be offset a desired amount when compared to the abutting rows of block elements 20.

In the preferred embodiment, the typical retaining wall 30 is assembled as follows, although the designs of retaining walls are varied as according to the stresses that are applied to the walls. Initially, a first row or course of block elements 20 is aligned on a foundation, with the block elements 20 being aligned in the desired manner with respect to each other. A second row of block elements 20 is further aligned on top of the first row of block elements 20. The user then distributes the anchoring stones 32 into the open central cores 28 of the block elements 20 of the second row of block elements 20 in the retaining wall 30. The anchoring stones 32 will descend through the central cores 28 of the block elements 28 in both the first and second rows due to gravitational pull and aggregate the anchoring stones 32 within the block elements 28. This aggregation of anchoring stones 32 in the central cores 28 will reinforce and lock the position of the retaining wall 30, and the anchoring stones 32 may be compacted within each row or course of block elements 20 such that they form a mechanical interlock between adjacent rows or courses of block elements 20. The anchoring stones 32 are preferably conventional natural rocks or consecrations of mineral material, with the anchoring stones 32 varying in size from small pebbles to rocks having approximately a one inch diameter. In addition, the anchoring stones 32 may be either natural or made of other synthetic materials having the desired rigidity and strength properties required for the present application.

Once the anchoring stones 32 have traversed the central cores 28 to secure the position of the initial rows of the retaining wall 30, the backfill material 8 is distributed proximate the retaining wall 30 such that the backfill material 8 is level with the uppermost edge of the second row of block elements 20. The mesh grid 9 is then placed substantially on the second row of block elements 20 and the backfill material 8. A third row of block elements 20 is further positioned on top of the second row of block elements 20 and the mesh grid 9 and properly aligned. To provide the positive connection and enhance the mechanical lock, the user will then pour a liquid resin 34 into the open central cores 28 of the block elements 20 of the third row of block elements 20. The synthetic resin 34 will distribute around the mesh grid 9 and into the interstices surrounding the various anchoring stones 32. The viscosity of the thick resin mixture 34 is such that it slowly spreads out over the mesh grid 9 and penetrates into the anchoring stones 32 below the mesh grid 9. The open central cores 28 of the third row of block members 28 are ten filed with additional anchoring stones 32 which comes into contact with liquid resin 34.

Consequently, the resin 34 will form the positive connection between the anchoring stones 32, the mesh grid 9, and the block elements 20 to form a positive interlock in a unitized structure. More specifically, once the synthetic resin 34 becomes motionless, it will coagulate or harden into a mass within the central cores 28 and around the anchoring stones 32 and the mesh grid 9 to form the positive connection. The coagulated synthetic resin 34 will reduce the amount of undesired redistribution of anchoring stones 32 in the retaining wall 30. Moreover, the coagulated synthetic resin 34 will lock the mesh grid 9 within the retaining wall 30 and will not allow the mesh grid 9 to be pulled out of the retaining wall 30, thus creating the positive connection between the mesh grid 9 and the block elements 20. It is to be noted that this process may be repeated for as many courses or levels of block members 20 as may be desired. Furthermore, it should be noted that the coagulated synthetic resin 34 also minimizes the loss of the anchoring stones 32 from the retaining wall 30 by keeping the anchoring stones 32 secured in place.

The synthetic resin 34 used in the present invention can be one of various types of resin materials having properties to transform from a liquid state to a solid state. For example, the synthetic resin 34 used in the present invention may be any one of the following: orthopathalic based polyester resin (unsaturated); isophthalic based polyester resin (unsaturated); dicyclopentadiene based polyester resin (unsaturated); vinyl ester based polyester resin (unsaturated); bisphenol epoxy vinyl ester resin, urethane-modified vinyl ester resin; elastomer-modified vinyl ester resin; biphenol fumarate polyester resin; terephthalic based polyester resin; epoxy resin; fumaric anhydride based polyester resin; polyurethane foaming resin; urethane elastomer resin; and adipic acid based polyester resin. Any and all combinations of these various synthetic resins 34 may be used in the anchoring composition 31. These synthetic resins 34 are helpful in that they are resistant to mildew, aging, and abrasion, so they will therefore maintain the positions of the surrounding stones 32. Furthermore, the synthetic resins 34 are virtually nonbiodegradable, such that the user will not be concerned with repeating the steps of dispensing the synthetic resin 34 in the central core 28 after a period of time.

Additionally, the block elements 20 described herein may be produced in a block-molding machine (not illustrated), as is well known. Preferably, the mold (not illustrated) is loaded with a selected mix of concrete or cement, and the mixture is set to form two block elements 20 simultaneously in a "siamese" pattern. Once the mixture has formed and cured, the block elements 20 may be split along the joined major faces 22 to form two trapezoidal split face block elements 20. Likewise, the block elements 20 may be formed from suitable plastic materials such as ABS or PVC by extrusion or molding. Decorative aluminum castings suitable for use as block elements 20 may be made by the lost foam casting method as is well known.

It should further be noted that the positive connection created through the use of the anchoring stones 32, synthetic resin 34, and mesh grid 9 reduces problems commonly found in conventional retaining walls. For example, when an excessive or unusual pressure is applied to conventional retaining walls to push the retaining wall forward, the mesh grid 9 frequently has a tendency to slide outward from between courses or levels of block elements 20 (which is called "pull out"). In the present invention, however, the positive connection created through the use of resin 34 with the anchoring stones 32 significantly increases the resistance of the mesh grid 9 to pull out from the retaining wall. Moreover, it should be noted that the mesh grid 9 may be placed on every other row of block elements 20 such that the positive connection is important to prevent the pull out of the mesh grid 9 between any of the rows of block elements 20.

Thus, although there have been described particular embodiments of the present invention of a new and useful IMPROVED RETAINING WALL ASSEMBLY, it is not intended that such references be construed as limitations upon the scope of this invention except as set forth in the following claims.

What is claimed is:

1. A resolute retaining wall comprising:

a plurality of trapezoidal first-tier block elements and a plurality of trapezoidal second-tier block elements, wherein each said second-tier block elements are positioned on said first-tier trapezoidal block elements, wherein each said first-tier block element and each said second-tier block element includes a central core traversing therethrough and a major wall, a minor wall parallel to said major wall; and a pair of opposing converging walls connecting said major wall with said minor wall, wherein said opposing converging walls are graduated in thickness from said minor wall to said major wall; and an anchoring composition traversing each said central core of each said block elements to unite said first-tier block elements with said second-tier block elements; and an anchoring composition traversing each said central core of each said block elements to unite said first-tier block elements with said second-tier block elements, said anchoring composition including a resin.

2. The retaining wall as described in claim 1 further comprising a mesh grid substantially positioned between said plurality of first-tier block elements and said second-tier block elements.

3. The retaining wall as described in claim 1 wherein said synthetic resin is a polyester resin.

4. The retaining wall as described in claim 1 wherein said synthetic resin is a polyurethane resin.

5. The retaining wall as described in claim 1 wherein said opposing converging walls of each said block element increase in thickness from said minor wall to said major wall by at least one-quarter inch.

6. The retaining wall as described in claim 1 wherein each said block element comprises a depth of about twelve inches and wherein said major wall has a length of between about seventeen and one-half inches and eighteen inches.

7. The retaining wall as described in claim 1 wherein said anchoring composition comprises a concretion of mineral matter.

8. The retaining wall as described in claim 1 wherein said anchoring composition comprises a rigid synthetic material.

9. A method for constructing a resolute retaining wall for holding a backfill composition, said method comprising the steps of:

a) placing a first row of first block elements on a foundation, each said first block element defining a first central core traversing said first block element;

b) dispersing a first plurality of anchoring stones into said first central cores of said first block elements;

c) placing a grid substantially on said first row of said first block elements;

d) placing a second row of second block elements on said first row of said first block elements, each said second block element defining a second central core traversing said second block element;

e) pouring a synthetic resin into said second central cores of said second block elements to flow onto said grid and said anchoring stones in said first central cores of said first block elements; and f) dispersing a second plurality of anchoring stones into said second central cores of said second block elements.

10. The method as described in claim 9, after step (f), repeating steps (c) through (f).

11. The method as described in claim 9 wherein step b) further comprises the step of placing said second block elements in an offset manner onto said first block elements.

12. A retaining wall assembly comprising:

a plurality of block elements stacked in a first row and a second row to form a retaining wall, each said block element having a central core traversing therethrough;

a plurality of anchoring stones distributed in said central cores of said block elements to resolutely secure said block elements; and a resin distributed through said central cores of said block elements around said anchoring stones.

13. The retaining wall assembly as described in claim 12 further comprising a mesh grid positioned between said first row of block elements and said second row of block elements.

14. The retaining wall assembly as described in claim 12 wherein said synthetic resin comprises a polyester resin.

15. The retaining wall assembly as described in claim 12 wherein said synthetic resin comprises a polyurethane resin.

16. The retaining wall assembly as described in claim 12 wherein said anchoring stones comprise a concretion of mineral matter.

17. The retaining wall assembly as described in claim 12 wherein said anchoring stones comprise a concretion of synthetic material.

18. The retaining wall assembly as described in claim 12 wherein said block elements are trapezoidal having a major wall and a parallel minor wall, said major wall connected to said minor wall by two opposing converging walls, wherein each said converging wall of each said block element is graduated in thickness from said minor wall to said major wall.

19. The retaining wall assembly as described in claim 18 wherein said opposing converging walls of each said trapezoidal block element increase in thickness from said minor wall to said major wall by at least one-quarter inch.

20. The retaining wall assembly as described in claim 12 wherein each said trapezoidal block element comprises a depth of about twelve inches and wherein said major wall has a length of between about seventeen and one-half inches and eighteen inches.

* * * * *